US011898834B1

(12) United States Patent
Major

(10) Patent No.: US 11,898,834 B1
(45) Date of Patent: Feb. 13, 2024

(54) MECHANICAL REARWARD DEPLOYING BROADHEAD

(71) Applicant: Berry Mtn., Inc., Liverpool, PA (US)

(72) Inventor: Jarrod Burk Major, Liverpool, PA (US)

(73) Assignee: Berry Mtn., Inc., Liverpool, PA (US)

( * ) Notice: Subject to any disclaimer, the term of this patent is extended or adjusted under 35 U.S.C. 154(b) by 0 days.

(21) Appl. No.: 17/974,933

(22) Filed: Oct. 27, 2022

Related U.S. Application Data

(60) Provisional application No. 63/272,295, filed on Oct. 27, 2021.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | |
|---|---|---|---|
| 5,879,252 | A | 3/1999 | Johnson |
| 6,217,467 | B1 | 4/2001 | Maleski |
| 6,270,435 | B1 | 8/2001 | Sodaro |
| 6,749,801 | B1 | 6/2004 | Grace, Jr. et al. |
| 6,830,523 | B1 | 12/2004 | Kuhn |
| 6,935,976 | B1 | 8/2005 | Grace, Jr. et al. |
| 7,234,220 | B1 | 6/2007 | Grace, Jr. |
| 7,377,869 | B2 | 5/2008 | Wohlfeil et al. |
| 7,713,151 | B2 | 5/2010 | Fulton |
| 7,713,152 | B1 | 5/2010 | Tentler et al. |
| 7,771,298 | B2 | 8/2010 | Pulkrabek |
| 8,118,694 | B1 | 2/2012 | Oliveira |
| 8,128,521 | B1 | 3/2012 | Ulmer |
| 8,133,138 | B1 | 3/2012 | Hannah |
| 8,182,378 | B1 | 5/2012 | Futtere |
| RE44,144 | E | 4/2013 | Barrie et al. |
| 8,435,144 | B2 | 5/2013 | Asherman |
| 8,449,415 | B2 | 5/2013 | Grace |
| 8,449,416 | B2 | 5/2013 | Grace et al. |
| 8,469,843 | B2 | 6/2013 | Mizek et al. |
| 8,475,302 | B1 | 7/2013 | Hummel, III |
| 8,545,349 | B1 | 10/2013 | Budris et al. |
| 8,771,112 | B2 | 6/2014 | Sanford |
| 8,894,519 | B2 | 11/2014 | Young |
| 8,905,874 | B2 | 12/2014 | Sullivan et al. |
| 8,926,457 | B2 | 1/2015 | Treto |
| 9,017,191 | B2 | 4/2015 | Treto |
| 9,228,813 | B1 | 1/2016 | Pedersen |
| 9,303,963 | B1 | 4/2016 | Ford |
| 9,341,449 | B2 | 5/2016 | Pedersen |
| 9,372,056 | B2 | 6/2016 | Sullivan et al. |
| 9,400,160 | B1 | 7/2016 | Miles |

(Continued)

*Primary Examiner* — John A Ricci
(74) *Attorney, Agent, or Firm* — Hooker & Habib, P.C.

(57) ABSTRACT

A rear-deploying broadhead for an arrow includes a ferrule, a rear deploying blade, and a spring. The ferrule has a slot that receives the blade, the blade movable axially in the slot between a retracted position and extended position that presents blade edges when penetrating a target. A spring disposed on the shank of the broadhead applies a spring force to the blade when the blade is in the retracted position that maintains the blade in the retracted position during arrow flight.

29 Claims, 16 Drawing Sheets

(56) References Cited

U.S. PATENT DOCUMENTS

| | | | | |
|---|---|---|---|---|
| 9,404,722 | B2 | 8/2016 | Pedersen | |
| 9,410,778 | B2 | 8/2016 | Pederseon | |
| 9,470,488 | B2 | 10/2016 | Motz | |
| 9,605,933 | B2 | 3/2017 | Pedersen | |
| 9,658,041 | B2 | 5/2017 | Powell | |
| 9,857,152 | B2 | 1/2018 | Franco, Sr. | |
| 9,857,153 | B1 | 1/2018 | Redline | |
| 9,903,693 | B2 | 2/2018 | Salvino et al. | |
| 9,945,647 | B2 | 4/2018 | Pugliese et al. | |
| 9,945,648 | B2 | 4/2018 | Grace | |
| 10,012,486 | B2 | 7/2018 | Pedersen | |
| 10,030,949 | B1 | 7/2018 | Grace | |
| 10,082,373 | B2 | 9/2018 | Romero | |
| 10,288,392 | B2 | 5/2019 | Hass | |
| 10,295,316 | B2 | 5/2019 | Wukie | |
| 10,309,754 | B2 | 6/2019 | Pugliese et al. | |
| 10,337,843 | B1 | 7/2019 | Kinzer | |
| 10,352,667 | B2 | 7/2019 | Salvino | |
| 10,393,485 | B1 | 8/2019 | Painter et al. | |
| 10,415,940 | B2 | 9/2019 | Sullivan et al. | |
| 10,436,556 | B1 | 10/2019 | Ohlau | |
| 10,458,767 | B2 | 10/2019 | Buchanan | |
| 10,591,262 | B1 | 3/2020 | Osborn et al. | |
| 10,809,044 | B2 | 10/2020 | Perry | |
| 10,823,537 | B2 | 11/2020 | Jones | |
| 10,837,742 | B2 | 11/2020 | Romero | |
| 10,895,440 | B2 | 1/2021 | Blosser et al. | |
| 10,895,441 | B2 | 1/2021 | Blosser et al. | |
| 10,900,757 | B2 | 1/2021 | Blosser et al. | |
| 11,118,878 | B2 * | 9/2021 | Albanese | F42B 6/08 |
| 11,125,542 | B2 | 9/2021 | Motz | |
| 11,226,180 | B1 | 1/2022 | Sullivan | |
| 11,340,051 | B2 | 5/2022 | Hand | |
| 11,448,492 | B1 | 9/2022 | Futtere | |
| 2003/0073525 | A1 * | 4/2003 | Liechty, II | F42B 6/08 473/582 |
| 2008/0045363 | A1 | 2/2008 | Pulkrabek | |
| 2016/0138897 | A1 | 5/2016 | Williamson | |

* cited by examiner

FIG. 15
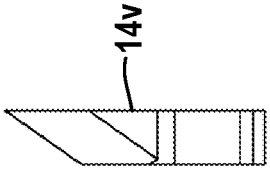
FIG. 14
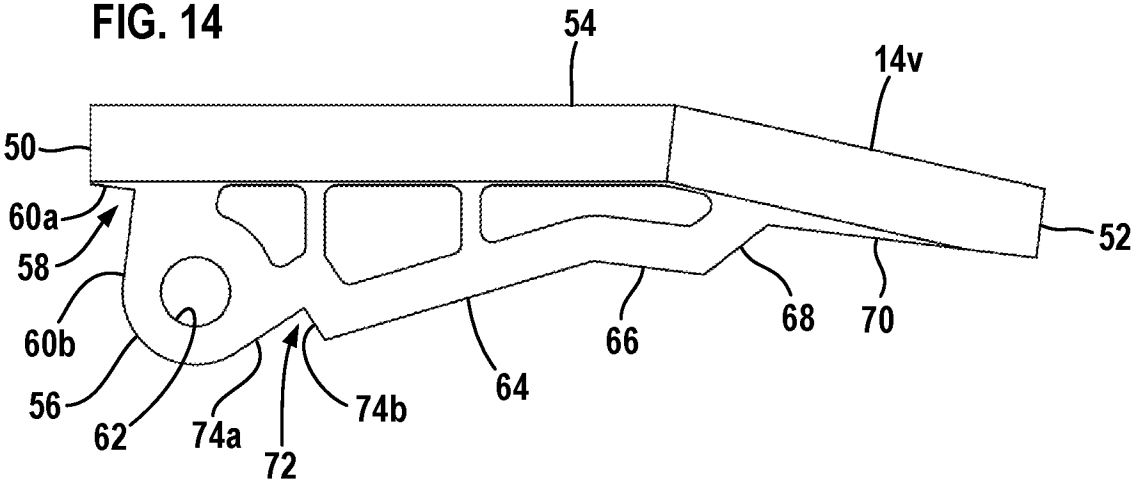
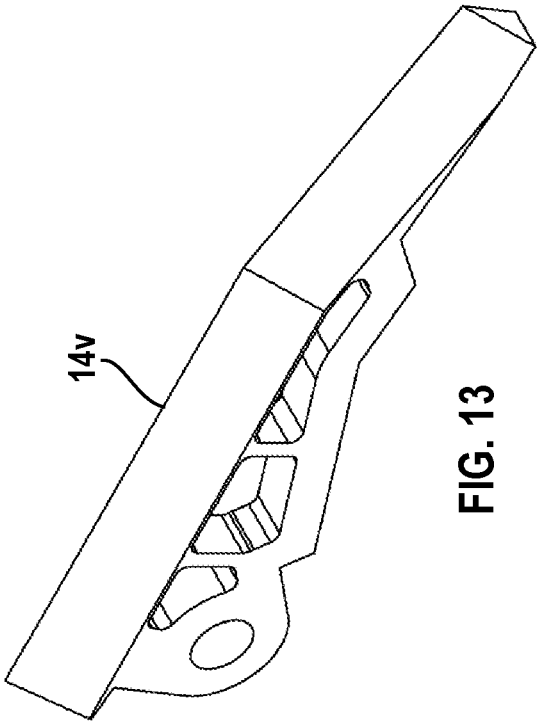
FIG. 13

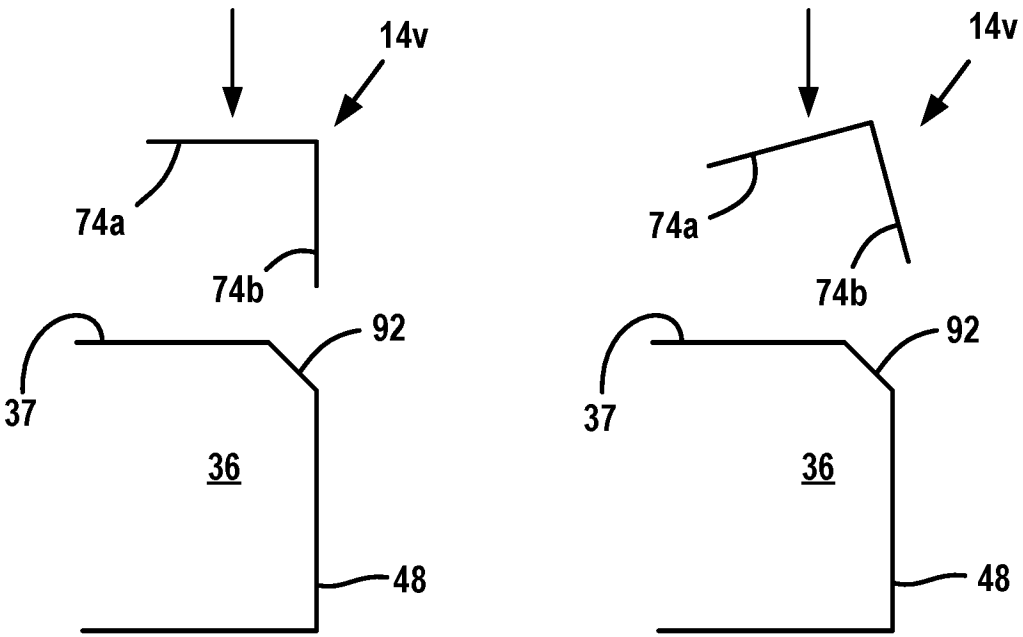
FIG. 39
FIG. 40
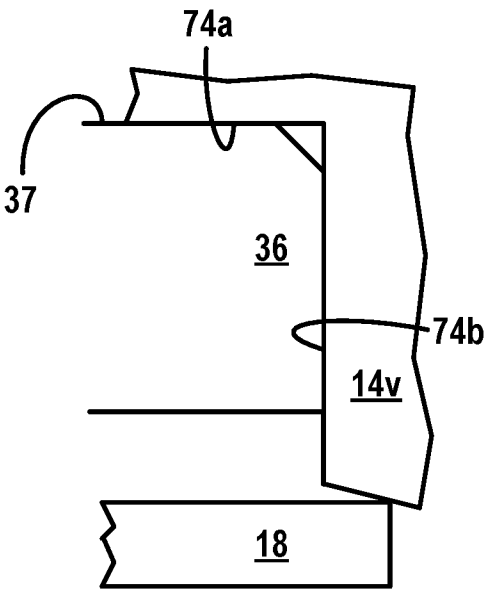
FIG. 41

FIG. 46
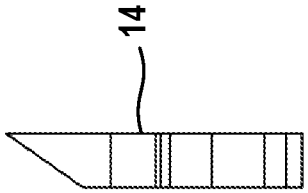
FIG. 45
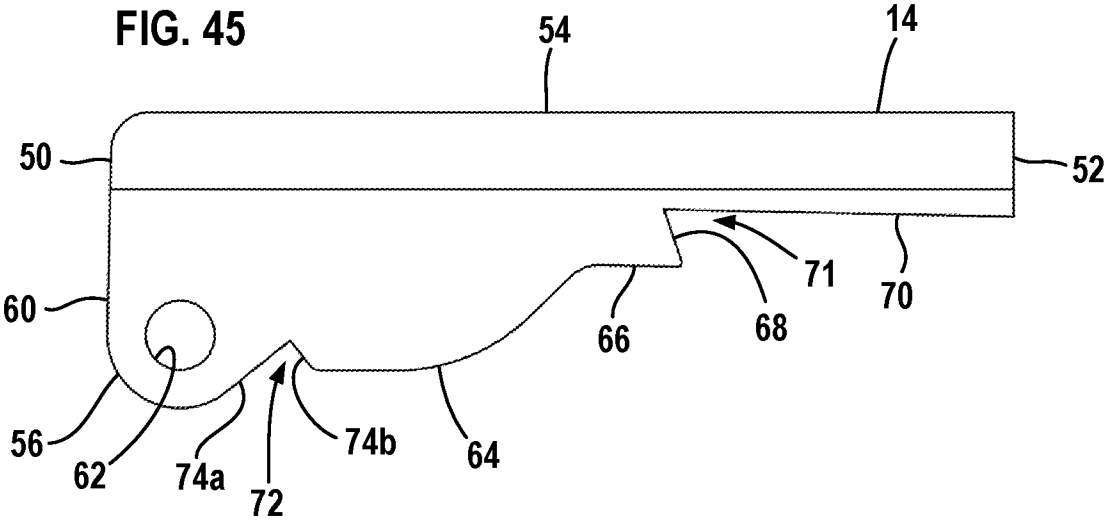
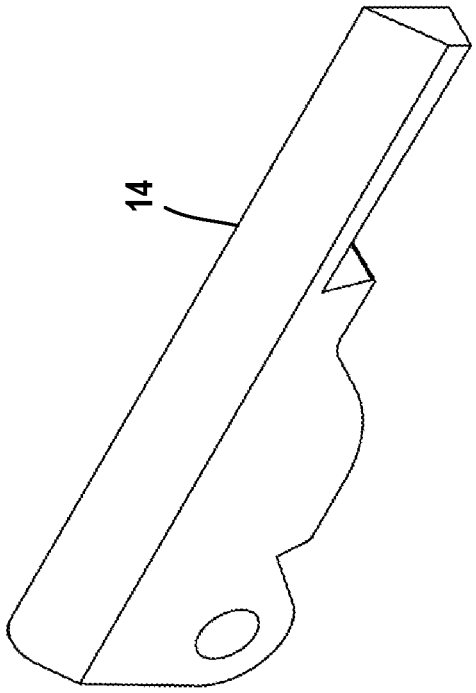
FIG. 44

MECHANICAL REARWARD DEPLOYING BROADHEAD

RELATED APPLICATION

This application claims priority to and the benefit of the filing date of provisional U.S. Patent Application No. 63/272,295 titled "Mechanical Rearward Deploying Broadhead" and filed Oct. 27, 2021, said provisional patent application incorporated by reference as if fully set forth herein.

FIELD OF THE DISCLOSURE

The disclosure relates generally to archery equipment, namely broadheads, and in particular, to mechanical expandable broadheads having rearward deploying blades.

BACKGROUND OF THE DISCLOSURE

Broadheads are a type of arrowhead mounted on the front of arrows and crossbow bolts (both referred to as "arrows" herein unless the context implies otherwise). Mechanical broadheads, sometimes referred to as expandable broadheads, have blades that are initially retracted when launched and then extend outwardly upon impact with a target to present cutting edges. The retracted blades reduce aerodynamic drag during arrow flight, increasing range and improving accuracy.

Rearward deploying broadheads have blades that translate and move axially rearwardly upon target impact from a retracted position to an extended position. The blades pivot to present the cutting edges as the blades move from the retracted position to the extended position.

Some rearward deploying broadheads have blades connected together by a pin or other connector body that slides in a bore of a ferrule carrying the blades. The connector body moves with the blades as the blades slide to the deployment position, causing simultaneous extending of the blades.

The blades and connector body are initially inserted into an open end of the bore at one end of the ferrule body. A stem or tip is then attached to the one end of the ferrule body to close the open end of the bore.

There is a need for a rearward deploying broadhead having simplified construction and allowing easier installation of blades into the broadhead, while still exhibiting reliable deployment of the blades at impact.

SUMMARY OF THE DISCLOSURE

Disclosed is a rearward deploying broadhead that has blades connected together by a connector body, the connector body slideable in a bore of a ferrule carrying the blades. The bore has permanently closed ends and so the tip or stem, or both the tip and stem, can be integral and unitary with the ferrule and not removable from the ferrule.

The disclosed rearward deploying broadhead provides simplified construction, allows easier installation of blades into the broadhead, and reliably deploys its blades at impact.

An embodiment of a broadhead in accordance with the present disclosure includes a one-piece unitary ferrule extending along a longitudinal axis, the ferrule extending axially from a tip or leading end being configured to pierce a target to an opposite shank end having a shank that attaches the broadhead to an arrow or like projectile. The ferrule includes an interior bore extending axially between spaced apart, opposite closed ends and a pair of slots extending from opposite sides of the ferrule into the ferrule and opening into the bore. The pair of slots receive respective blades that are movable in the slots along the ferrule between longitudinally spaced-apart retracted and deployed positions adjacent the tip end and shank end of the ferrule respectively.

A connection member formed as a pivot pin in an interior bore of the ferrule connects the two blades and moves in the bore with the blades. A radial hole extends from the outside of the ferrule and opens into the bore. The radial hole is sized to receive the pivot pin. The pivot pin passes fully through the radial hole and into the ferrule bore to enable the pivot pin to move with the blades between retracted and deployed positions. The pivot pin connects the blades and defines a pivot axis of the blades.

A spring assembly mounted on the ferrule shank applies a force to the blades maintaining the blades in the retracted position during arrow flight, while allowing the blades to move rearwardly and present the blade cutting edges with target impact and penetration. The blades have surfaces that engage against the ferrule and cause the blades to extend away from the ferrule as the blades translate to the extended position during penetration of the broadhead into the target. The spring also generates a force applied to the blades resisting pivotal movement of the blades away from the extended position during continued penetration of the broadhead into the target once the blades reach the extended position.

In one embodiment of the disclosed broadhead a forward portion of each blade of the broadhead disposed outside of the slot is urged against a forward portion of the ferrule when the blade is in the retracted position. In a second embodiment of the disclosed broadhead a trailing portion of each blade of the broadhead disposed outside of the slot is against a member when the blade is in the retracted position. The member can be a surface of the ferrule, another member of the broadhead that is not the ferrule, or the arrow to which the broadhead is attached.

The disclosed broadhead has a number of advantages. Construction of the ferrule is simplified and installation of the blades in the ferrule is not complicated. The spring mechanism is easy to install and reliably maintains the blades in the retracted position upon the launch of the arrow and during the arrow flight, and can assist in maintaining the blades in the extended position while the broadhead penetrates the target.

Other objects and features of the disclosure will become apparent as the description proceeds, especially when taken in conjunction with the accompanying drawing sheets illustrating one or more illustrative embodiments.

BRIEF DESCRIPTION OF THE DRAWINGS

FIGS. 13-15 are perspective, front, and side views respectively of one of the ventilated blades shown in FIG. 1.

FIGS. 39-40 illustrate different possible relative position of a blade of the broadhead shown in FIG. 2 with respect to the trailing end surface of the slot as the blade approaches the extended position of the blade.

FIGS. 44-46 are perspective, front, and side views respectively of one of the solid blades shown in FIG. 41.

DETAILED DESCRIPTION

Figure 1:
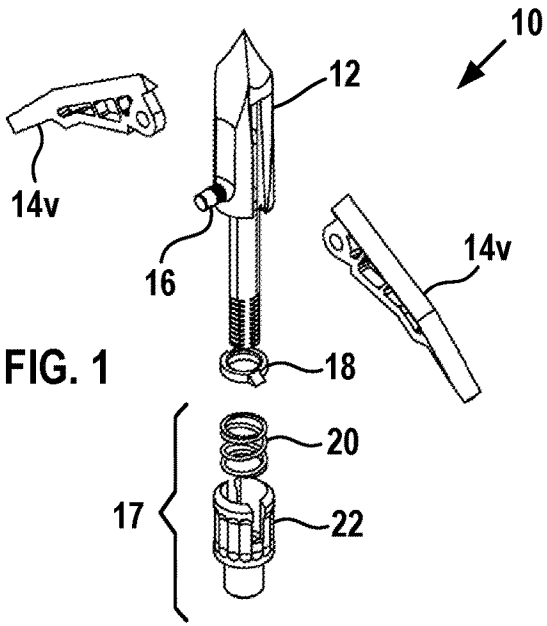
FIG. 1 is an exploded view of a first embodiment rearward deploying broadhead in accordance with this disclosure, the broadhead having vented blades.

FIG. 1 is an exploded view of a first embodiment broadhead 10 in accordance with this disclosure illustrating the different components of the broadhead. The broadhead 10 can be used with vented blades or non-vented blades. The broadhead 10 is illustrated in FIGS. 2 and 3 with vented blades and in FIGS. 4 and 5 with solid, non-vented blades.

The broadhead 10 includes a ferrule 12, a pair of like vented blades 14*v*, each blade 14*v* having a number of through holes or vents extending through the thickness of the blade, a connecting member formed as a pivot pin 16, and a spring mechanism 17 consisting of a cam member 18, a compression spring 20, and a spring cap 22. The illustrated cam member 18 is formed as a generally ring-shaped cam ring 18.

Figure 2:
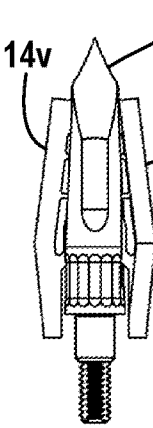
FIGS. 2 and 3 illustrate the broadhead shown in FIG. 1 with the blades in the retracted and deployed positions respectively.
Figure 3:
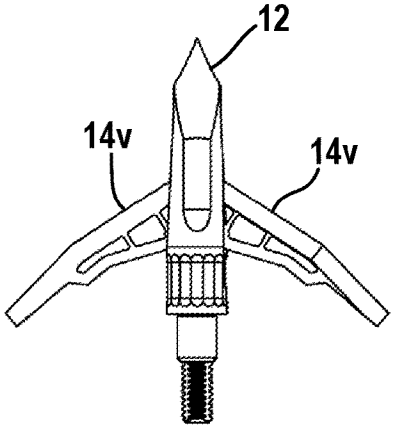
Figure 4:
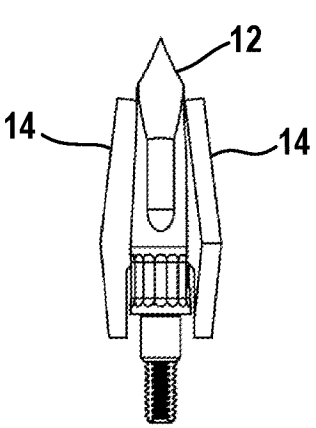
FIGS. 4 and 5 are otherwise identical to FIGS. 2 and 3 respectively but with solid, non-vented blades.
Figure 5:
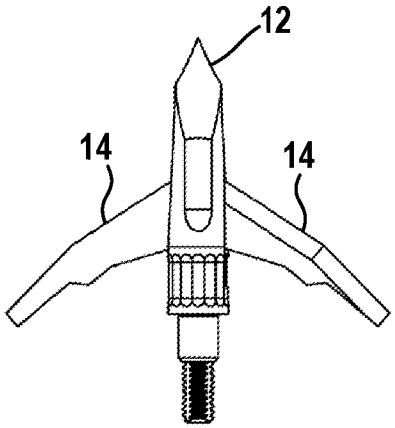
Figure 10:
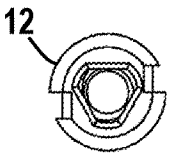
FIG. 10 is a bottom view of the ferrule shown in FIG. 8.
Figure 9:
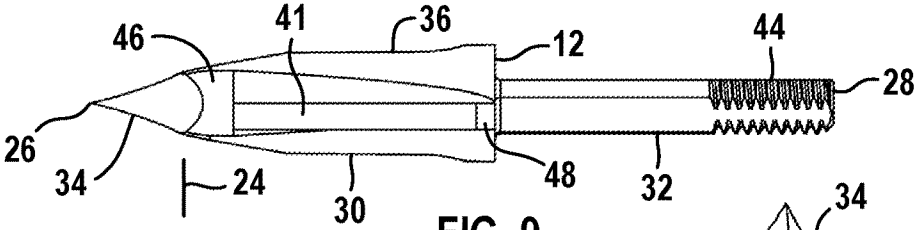
FIG. 9 is a side view of the ferrule shown in 8 taken along line A of FIG. 8.

FIGS. 2 and 3 illustrate the broadhead 10 with the blades 14*v* in the retracted position and extended position respectively. FIGS. 3 and 4 are like FIGS. 2 and 3 but illustrates the broadhead 10 having non-vented blades 14. The non-vented blades 14 are manufactured to be otherwise identical to the vented blades 14*v* with the only exception no vents are formed in the non-vented blades 14. The description of the broadhead 10 will assume the use of vented blades 14*v*.

FIGS. 6-12 illustrate the ferrule 12. The illustrated ferrule 12 is formed as a one-piece, unitary, homogeneous member that in the illustrated embodiment is made of titanium. The ferrule 12 can be made of other metals or materials, for non-limiting examples stainless steel or steel, using suitable manufacturing techniques.

The ferrule 12 is an elongate member that extends downwardly along a longitudinal center axis 24 (see FIG. 11) from a leading or tip end 26 to an opposite trailing or shank end 28. Disposed at the tip end is a ferrule body portion 30 extending axially away from the tip end. Disposed at the shank end is a reduced-diameter shank 32 extending from the ferrule body portion 30 axially to the shank end 28.

The ferrule body portion 30 includes a penetrating tip portion 34 formed in the illustrated embodiment as a sharp chisel point that initially contacts the target on impact. Penetrating tip portions that include a fixed blade having a cutting edge that initially contacts the target on impact can also be adapted for use with rear deploying broadheads in accordance with this disclosure.

Extending from the penetrating tip portion 34 to the shank 32 is a generally cylindrical blade-holding portion 36 that holds the pair of rear-deploying blades 14*v*. The blade-holding portion 36 extends axially away from the tip end to a generally annular bearing surface 38 defining the lower end of the blade-holding portion 36. A circular groove 39 formed on the annular bearing surface 38 is centered about the axis 24.

As previously mentioned, the ferrule 12 is formed as a one-piece homogeneous member. The penetrating tip portion 34, the blade-holding portion 36, and the shank 32 are permanently connected together and in this embodiment broadhead are not intended to be separated from one another.

Extending into the blade-holding portion 36 is an elongate slot 40 extending into the ferrule 12 from opposite sides of the ferrule. The slot 40 extends axially from a flat upper leading end surface 35 defining a leading end of the slot to a flat lower trailing end surface 37 that defines a trailing end of the slot.

Figure 23:
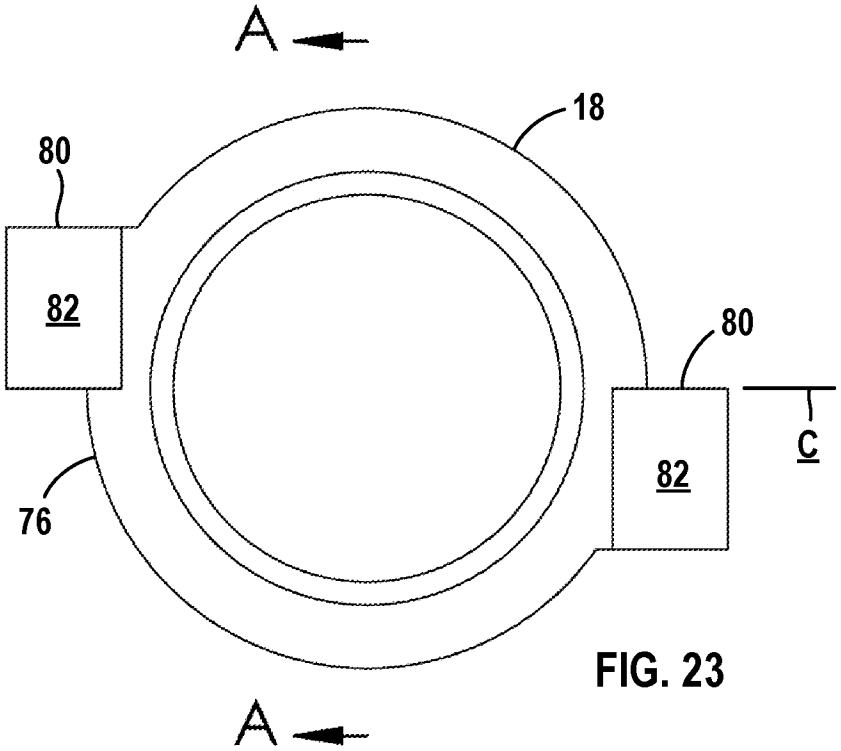
Figure 24:
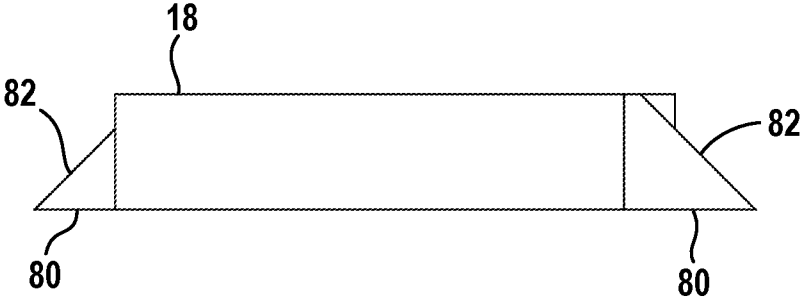
Figure 29:
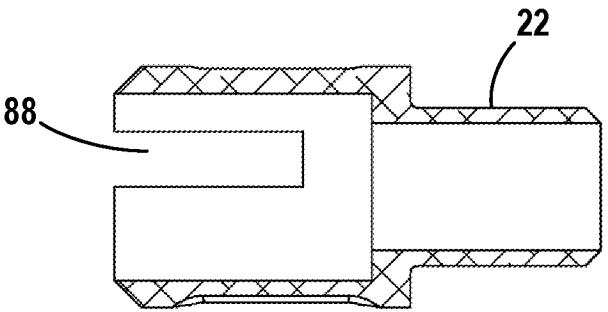
FIG. 29 is a section view of the spring cap shown in FIG. 28 taken along line A-A of FIG. 28.
Figure 26:
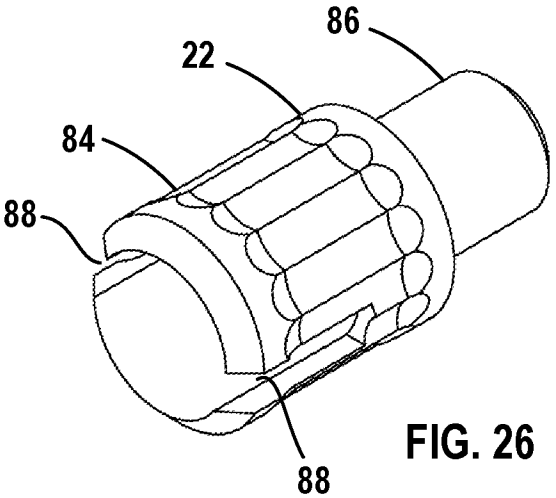
FIGS. 26-28 are perspective, front, and top views respectively of the spring cap shown in FIG. 1.
Figure 28:
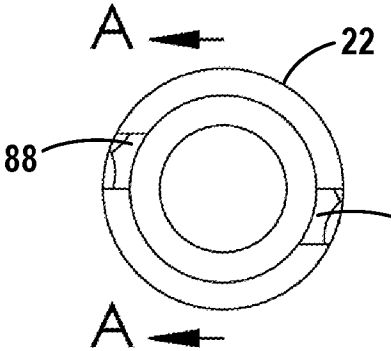
Figure 27:
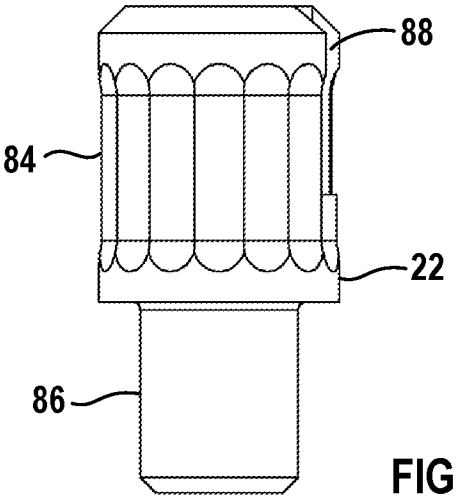

The slot 40 has a pair of blade openings 41 on opposite sides of the slot that each receives a respective blade 14*v* into the slot. See FIGS. 8, 11, and 12. The blade openings 41 are offset from one another to be on opposite sides of a central plane P (see FIG. 23) extending through the center axis 24. The plane P is perpendicular to the drawing sheet as viewed in FIG. 23. The blade openings 41 are aligned to locate the blades side-by-side into the slot and enable the blades 14*v* to translate in the slot 40 between the retracted position and the extended deployed position of the blades.

Figure 21:
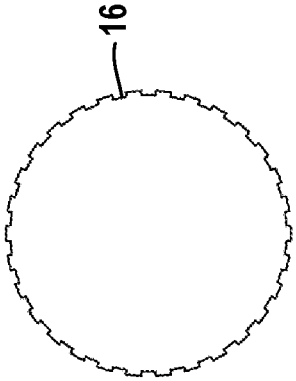
FIGS. 19-21 are perspective, front, and end views respectively of the connecting member shown in FIG. 1.
Figure 20:
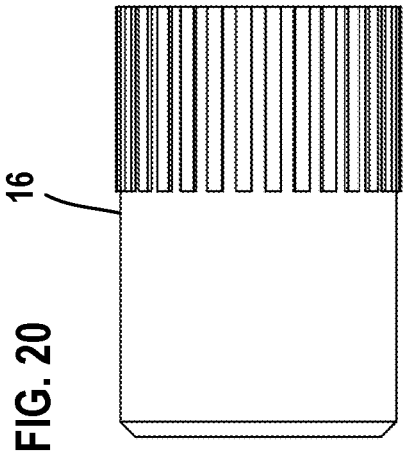
Figure 19:
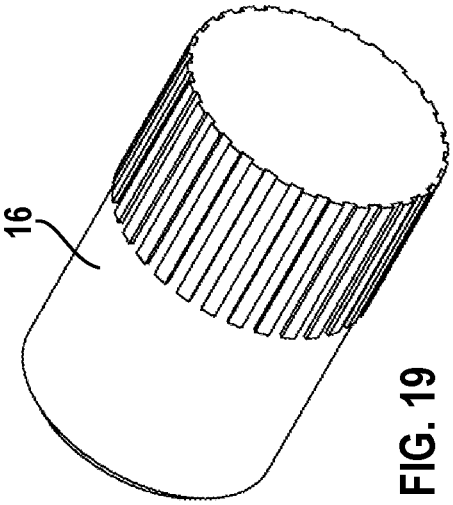
Figure 22:
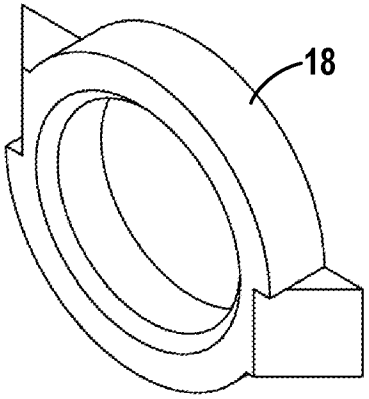
FIGS. 22-24 are perspective, top, and front views respectively of the cam ring shown in FIG. 1.
Figure 25:
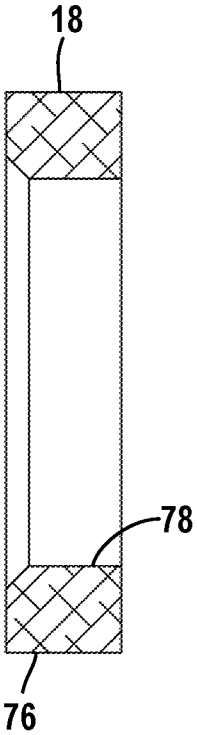
FIG. 25 is a sectional view of the cam ring shown in FIG. 23 taken along line A-A of FIG. 23.

A radial hole 42 extends from the outer surface of the blade-holding portion 36 into the slot 40 in a direction perpendicular to the plane P. The through-hole 42 is sized to closely receive the pin 16 through the hole and to enable the pin 16 (shown in FIGS. 19-21) to be received fully into the slot 40. The pin 16 may be a knurled pin as shown in FIGS. 19-21, or in other embodiments may have a smooth outer surface, have a different knurling design or coverage area on the pin, or the like.

Depth of insertion of the pin 16 into the ferrule 12 is limited by the bore wall 43 opposite and facing the through-hole 42. The pin 16 extends into holes formed in the blades 14*v* that pivotally mount the blades 14*v* to the pin and enables the pin to axially translate in the slot 40 with the blades. The pin rotatably/pivotally connects the blades and defines a common pivot axis of the blades as the blades pivot while translating from the retracted position to the extended position.

The pin 16 also helps support the blades 14*v* or 14 in proper vertical alignment parallel with the plane P while the blades are in the retracted position, the extended position, and positions in between the retracted and extended positions. The pin resists tilting of the blades away from parallel with respect to the plane P by engaging the annular walls surrounding the blade holes.

A portion of the shank 32 at the ferrule shank end 28 has external threads 44 for removably attaching the broadhead 10 to an end of an arrow (not shown). Thread sizes are standardized for attaching a broadhead or other arrow head to different sizes and types of arrows.

The ferrule 12 includes structure that cooperates with structure of the blades 14*v* (described later below) and spring force generated by the spring assembly 17 to resist pivotal and translation of the blades when the blades are in the retracted position during arrow flight, and resists pivotal movement of the blades away from the extended position when the blades are penetrating a target as will be described in more detail later below.

Formed on the outside of the blade-holding portion 36 adjacent the upper end of each slot blade opening 41 is a flat outer upper bearing surface 46 that extends across the full width of the adjacent blade opening perpendicular to the plane P and extends axially from the upper slot blade opening upwardly towards the leading end of the ferrule.

Figure 6:
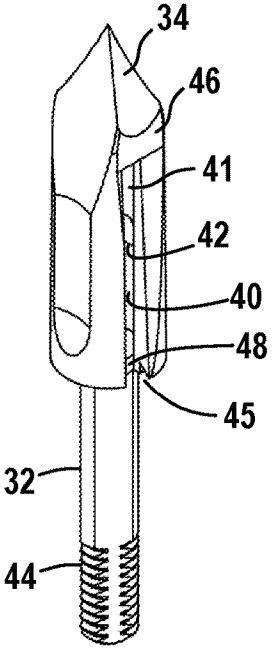
FIG. 6 is a perspective view of the ferrule of the broadhead shown in FIG. 1.
Figure 11:
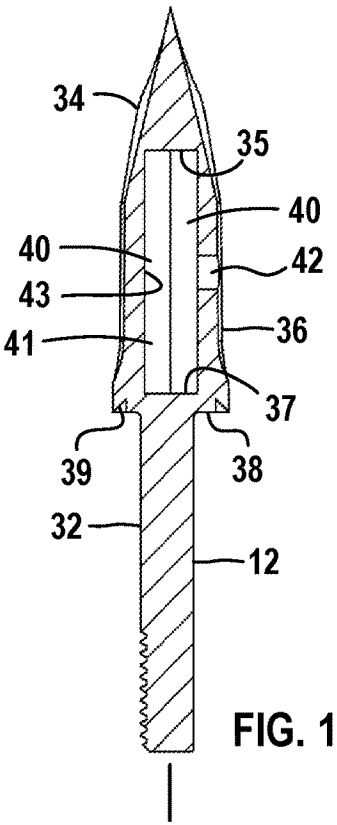
FIGS. 11 and 12 are sectional views of the ferrule shown in FIG. 7 taken along lines A-A and B-B of FIG. 7.
Figure 8:
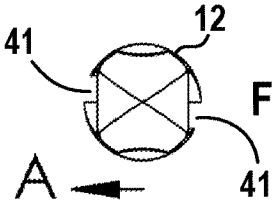
FIG. 8 is a top view of the ferrule shown in FIG. 6.
Figure 7:
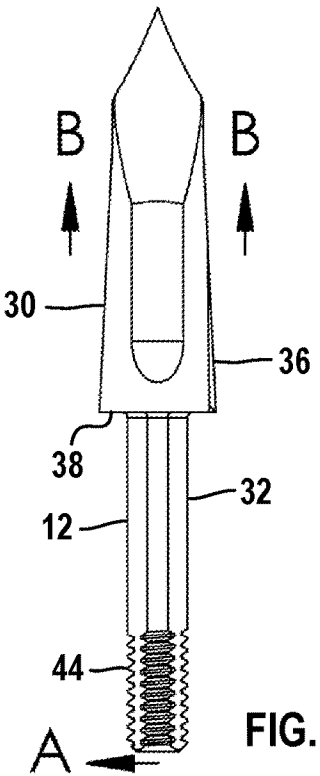
FIG. 7 is a front view of the ferrule shown in FIG. 6.
Figure 12:
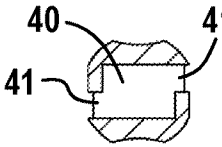

The slot 40 ends before reaching the lower end surface 38 of the ferrule blade-holding portion 36. Formed on the outside of the blade-holding portion 36 adjacent the lower end of each slot blade opening 41 is a flat outer lower bearing surface 48 that extends across the full width of the adjacent blade opening perpendicular to the plane P and extends axially downwardly from the slot blade opening to the lower end surface 39 of the blade-holding portion 36. The lower bearing surfaces 48 are also recessed into the blade-holding portion to be essentially flush with the inner lower ends of the slot blade portions 41 as best seen in FIG. 6.

The ferrule 12 can be designed with a slot 40 having slot blade openings 41 that are configured to closely receive a blade of a specific thickness. For example, a slot 40 may, in embodiments, be configured for blades having a blade thickness of up to 0.054 inches, greater than 0.054 inches and up to 0.25 inches, or more than 0.25 inches. Thicker blades can be made for use with today's high-speed crossbows as well as the even higher-speed crossbows coming in the future.

Figure 18:
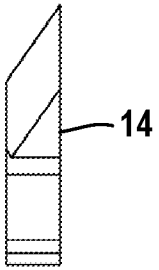
FIGS. 16-18 are perspective, front, and side views respectively of one of the non-ventilated blades shown in FIG. 5.
Figure 17:
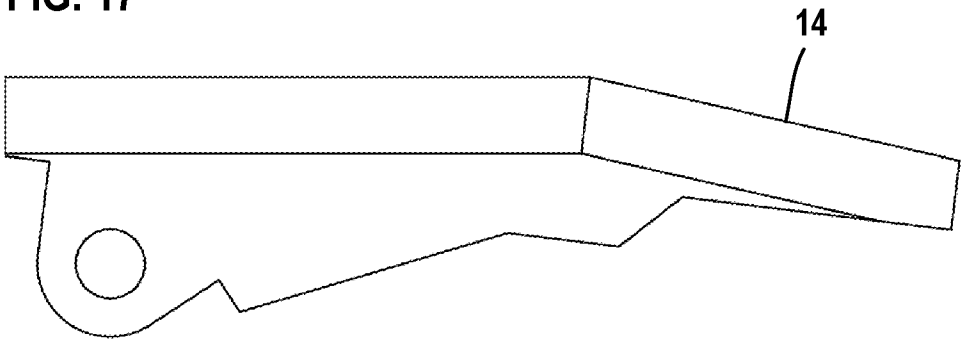
Figure 16:
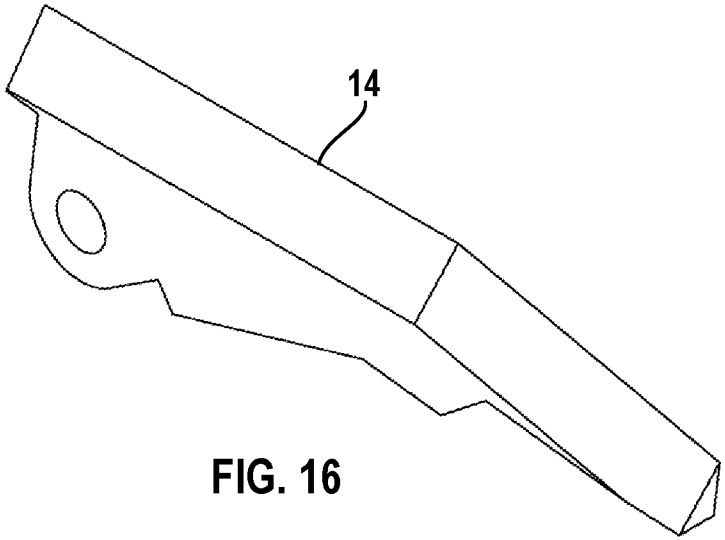

FIGS. 13-15 illustrate a ventilated blade 14*v* shown in FIG. 2 and described in more detail below. FIGS. 16-18 illustrate a non-ventilated blade 14 shown in FIG. 5. Except for not being ventilated, the non-ventilated blade 14 is otherwise identical to the ventilated blade 14 and so will not be described in detail.

The ventilated blade 14*v* shown in FIGS. 13-15 is cut from metal plate, but may in alternative embodiments be made of other materials or made by other manufacturing methods. The blade extends from a flat leading end 50 having a flat surface that is disposed adjacent to and extends transversely away from an outer bearing surface 46 of the ferrule 12 when the blade is in its retracted position to a trailing end 52. A cutting edge 54 is formed on an outer side of the blade and runs the full length of the blade. The blade 14*v* has a uniform blade thickness except where the blade tapers to the cutting edge 54.

A blade connection portion 56 is located near the leading end of the blade and is spaced inwardly from the leading end by a first square corner 58 defined by corner surfaces 60*a*, 60*b*. The blade connection portion 56 defines a through-hole 62 extending through the thickness of the plate. The through-hole 62 is sized to closely receive the pin 16 to rotatably connect the blade to the pin. Angularly displaced with respect to the center of the through hole 62 is a second square corner 72 defined by corner surfaces 74*a*, 74*b*. Extending away from the blade connection portion 56 forming a spine of the blade on the opposite side from the cutting edge is a first inner surface 64, then a second inner surface 66, then a third inner surface 68, and finally a fourth inner surface 70.

The first corner 58 and its associated corner surfaces 60*a*, 60*b* cooperate with the blade's second inner surface 66 in maintaining the blade in its retracted position shown in FIG. 2 as will be explained in more detail below. The inner surface 64 acts as a camming surface that forces the blade to rotate about the pin 16 in a controlled manner from its relative angular position with respect to the pin in the blade's retracted position shown in FIG. 2 to its angularly displaced relative position with respect to the pin in the blade's extended position shown in FIG. 3. The second corner 72 and its associated corner surfaces 74*a*, 74*b* form bearing surfaces that cooperate with the blade's camming surface 64 in maintaining the blade in its extended position as will be explained in more detail below.

The cam ring 18 is illustrated in FIGS. 22-25. The cam ring has a circular body 76 defining a through-hole 78 extending along an axis. Formed on the body are a pair of like inclined camming members formed as ramps 80. Each ramp has a flat cam surface 82 inclined with respect to the axis that slopes downwardly as the surface extends away from the body 76 (the illustrated surfaces 82 are inclined at an angle of about 45 degrees). The ramps 80 are offset from one another and disposed along opposite sides of a central plane C (see FIG. 23) that is perpendicular to the drawing sheet as viewed in FIG. 23 to axially align with the side-by-side blades 14. The ramp cam surfaces 82 extend in opposite directions away from the body 76

The spring cap 22 is illustrated in FIGS. 26-29. The spring cap is a tubular body having an enlarged diameter tubular portion 84 disposed at one end of the body and a coaxial reduced diameter tubular portion 86 at the opposite end of the body. The enlarged tubular portion is sized to closely receive the body of the cam ring 18 and the spring 20 on the shank 38. The reduced tubular portion is sized to closely receive the ferrule shank 32 and is received in the arrow when the broadhead 10 is attached to the arrow.

A pair of slots 88 formed on opposite sides of the enlarged tubular portion 84 extend from the one end of the body into the body. The slots 88 are sized and disposed to receive the ramps 80 extending through the slots and enable the cam ring 18 received in the enlarged tubular portion to move axially with respect to the spring cap.

The illustrated spring cap 22 has ornamental grooves formed on the outside of the enlarged tubular portion 84 that have no functional purpose.

Figure 30:
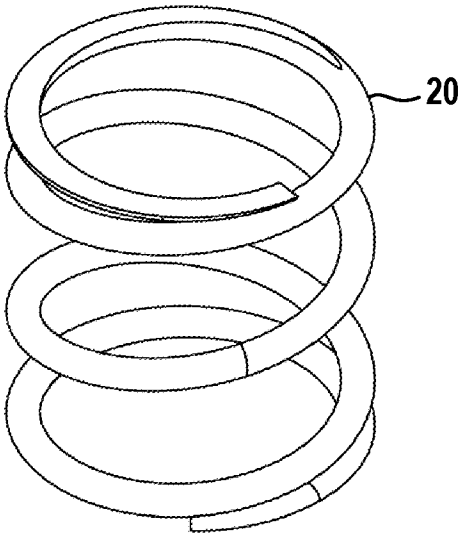
FIGS. 30-32 are perspective, front, and top views respectively of the compression spring shown in FIG. 1.
Figure 32:
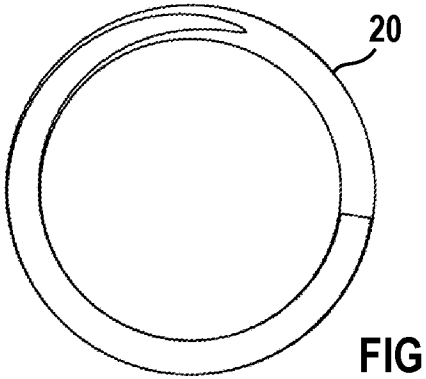
Figure 31:
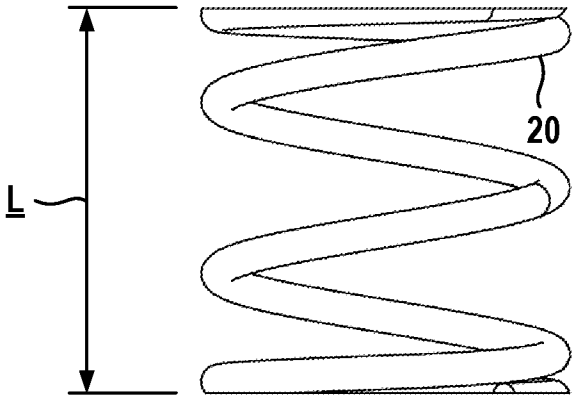

The compression spring 20 is illustrated in FIGS. 30-32. The compression spring 20 is formed as a coil spring sized to have a relaxed axial length L (FIG. 31) but is compressed in use to generate an axial spring force.

Figure 33:
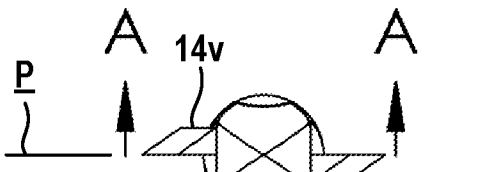
FIG. 33 is a top view of the broadhead shown in FIG. 2.
Figure 34:
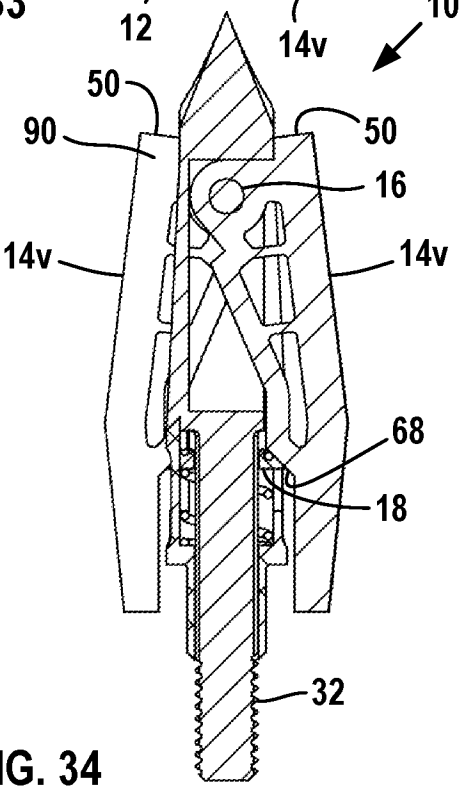
FIG. 34 is a sectional view of the broadhead shown in FIG. 33 taken along line A-A of FIG. 33.
Figure 37:
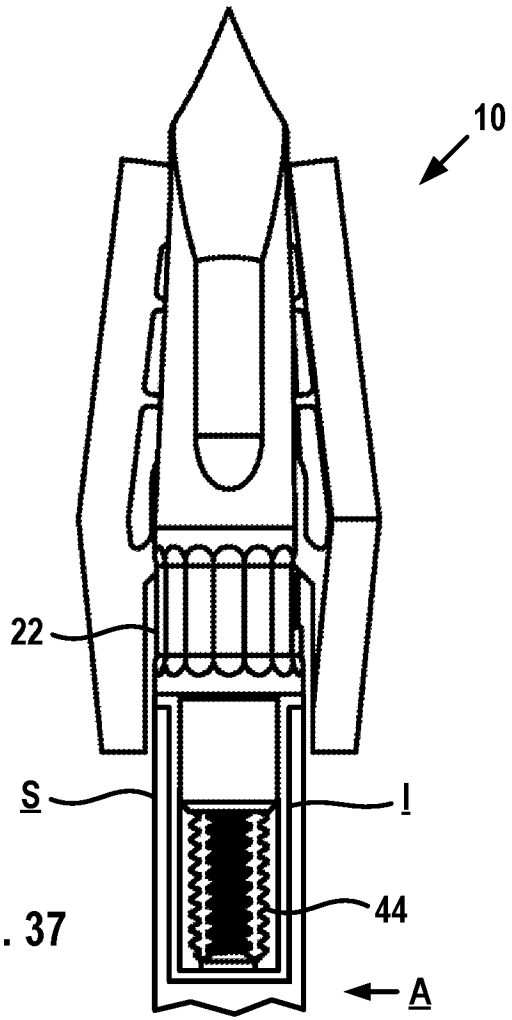
FIG. 37 is similar to FIG. 2 but with the broadhead attached to an arrow.

FIGS. 33 and 34 illustrate in more detail the broadhead 10 ready for use with the blades 14*v* in the retracted position, and FIG. 37 illustrates the broadhead 10 attached to an arrow shaft S to form a broadhead arrow A. As shown in FIG. 37, the threaded shank portion 44 of the ferrule is threaded into a threaded insert I of the arrow shaft S. Threading the shank portion 44 into the insert receives the lower portion of the spring cap 22 into the insert. The insert forces the beveled upper end of the spring cap 22 into the ferrule groove 39 and against the bearing surface 38 of the ferrule 12, forming a smooth transition from the ferrule blade-holding portion 36 to the spring cap 22. The spring cap 22 becomes captured between the ferrule 12 and the insert, sandwiching the spring cap 22 between the arrow insert and the blade-holding portion 36. The spring cap 22 is axially fixed with respect to the ferrule 12.

The cam ring 18 and coil spring 20 are disposed in the enlarged tubular portion 84 of the spring cap 22. The cam ring is axially movable in the spring cap 22 along the shank. The coil spring 20 is compressed, generating a spring force that the cam ring towards the ferrule blade-holding portion 36, with the camming members 80 of the cam ring axially aligned with the slot openings 41. The coil spring 20 is compressed when the cam ring 18 is against the ferrule blade-holding portion 36 and becomes more compressed when the cam ring 18 is spaced away from the blade-holding portion 36.

Figure 38:
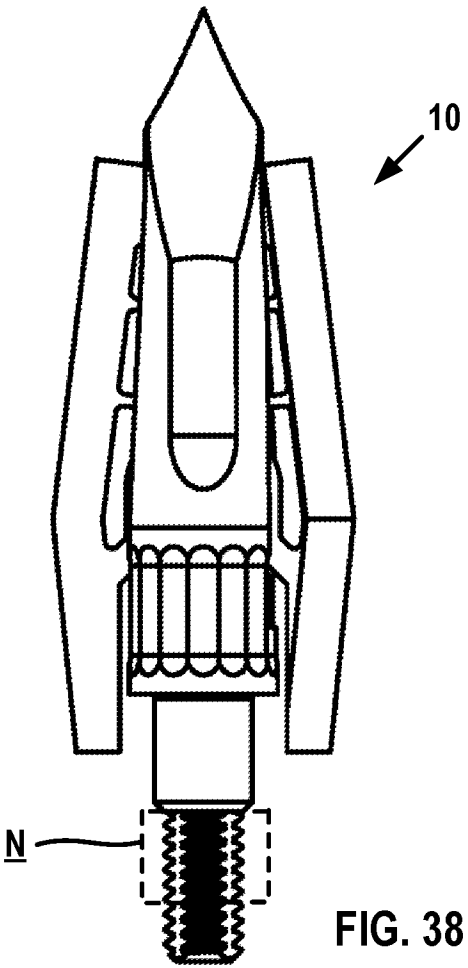
FIG. 38 is similar to FIG. 2 but with a temporary member attached to the broadhead shank to maintain the broadhead in an assembled state while the broadhead is not attached to an arrow.

FIG. 38 illustrates a member N (shown in dashed lines) threaded on the ferrule threaded shank portion to maintain the assembly 10 in an assembled state when the broadhead 10 is not mounted on an arrow. The member N can be realized as a plastic nut or other easily removable member that can maintain the cap spring in position along the ferrule shank.

Referring back to FIGS. 33 and 34, the blades 14*v* are pivotally connected by the pin 16 extending through both blade through-holes 62, the pin defining a common pivot axis of the blades. The pin 16 is disposed in the slot 40.

The forward flat ends 50 of the blades 14*v* are disposed on a forward portion 90 of each blade. The forward portion 90 of the blade extends out of the slot 40 when the blades 14*v* are in the retracted position, extending axially beyond the upper end of the slot towards the penetrating tip portion 34 to the blade forward end 50.

The forward blade ends 50 are disposed transverse to the ferrule axis 24, and face toward the leading end 26 of the ferrule 12. The blade corner surfaces 60*a*, 60*b* are disposed respectively against the ferrule outer upper bearing surfaces 46 and against the leading end surface 35 of the slot 40. The blade cutting edges 54 are located entirely outside of the slot 40.

Figure 35:
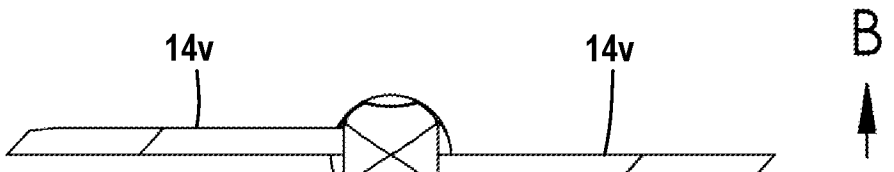
FIG. 35 is a top view of the broadhead shown in FIG. 3.

The second inner surface 66 of each blade 14*v* is disposed to face and extend axially parallel along a respective ferrule facing surface 48. The facing surface 48 faces an intermediate portion of the inner surface 66. The blade inner surface 66 extends beyond the facing surface 48 to the adjacent blade inner surface 68. The blade inner surface 68 extends away from the longitudinal axis 24 at an angle of about 45 degrees as shown in FIG. 35.

The cam ring 18 is aligned on the ferrule shank 32 with the camming members 80 aligned circumferentially with the slot blade openings 41 as previously described. The blade camming surfaces 68 engage and press against the cam ring ramp cam surfaces 82, forcing the cam ring 18 to be spaced along the shank 32 away from the ferrule body 30 as shown in FIG. 34, further compressing the coil spring 20 and generating more spring force.

The cam ring ramp cam surfaces 82 transmit the spring force to the blade inner surfaces 68, applying axial first force components and radial second force components to the blade inner surfaces 68. The axial force components urge the blades 14*v* axially towards the leading end 26 of the ferrule 12, pressing the blade first corner surfaces 60*b* against the upper ends of the slots 40. The radial force components apply moments to the blades urging the blades to pivot about the pivot pin 16 and extend the blades out of the slots and away from the ferrule 12. Pivoting of the blades about the pin axis is resisted by the moments pressing the blade first corner surfaces 60*a* against the ferrule upper bearing surfaces 46.

As a result of the blades 14*v* being pressed against the ferrule 12 by the spring force, the blades are held in their retracted positions and can remain in their retracted position during flight of the arrow A until the broadhead impacts and penetrates a target.

Operation of the broadhead 10 in deploying the blades 14*v* with impact and penetration of a target is described next.

With penetration of the penetrating tip portion 34 into the target, the blade forward ends 50 now impact the target. The ferrule 12 is moving on a line of impact at impact, and the target applies a force opposite the line of impact resisting penetration while the ferrule 12 is penetrating the target. The applied force urges the blades 14*v* and the pin 16 carried by the blades axially away from the upper end 35 of the slot 40 towards the lower end 37 of the slot 40.

Initial axial movement of the blades generated by the forces applied to the forward blade ends 50 causes the blades to further displace the cam ring 18 along the shank 32 away from the ferrule bearing surface 38. However, the initial axial movement of the blades maintains the blade first corner surfaces 60*a* facing the ferrule upper bearing surfaces 46 and the blade inner surfaces 66 moving along the ferrule lower facing surfaces 48. This maintains the blades stationary with respect to one another during this initial axial movement. The ability to have the blades remain in their retracted orientation even with some initial movement of the blades prevents inadvertent low force impacts against the blades from leaves, twigs, or the like from causing the blades to deploy.

With continued penetration of the broadhead 10 into the target, the target continues to apply forces to the blades 14*v* causing the blades 14*v* and the cam ring 18 to continue axial movement along the ferrule 14. The forward portions 90 of the blades 14*v* translate towards the trailing end of the ferrule 12 and move to face the slot 40, with the blades' first corner surfaces 60*a* clearing the ferrule upper bearing surfaces 46. The camming surfaces 64 of the blades now also come into contact with respective sides of the slot trailing end surface 37. The trailing end surface 37 forces the camming surfaces 64 to pivot and causes the entire blades to pivot about the pin 16 towards their fully extended angular positions.

The target additionally applies force to the blades 14 as the broadhead 10 continues to penetrate into the target. The force applied to the blades resists the pivoting of the blades, but is not sufficient to prevent angular extension of the blades.

When the blade camming surfaces 64 first engage the slot trailing end surface 37, the blades 14*v* are engaged against the cam ring 18. Pivotal movement of the blades causes the blades to disengage from the cam ring 18. The blades can now translate towards the extended position of the blades without resistance from the cam member 18 compressing the spring 20. This assists in enabling the blades to open and overcome the resistance to blade opening generated by the force applied to the blade by the target. The cam ring 18 is urged by the coil spring 20 against the lower bearing surface 38 of the ferrule blade-holding portion 36.

The blades 14*v* pivot about the pivot pin 16 as the camming surfaces 64 pivot until the end of the camming surface 64 is against the slot trailing end surface 37. At this point the blades 14*v* have pivoted to their fully extended axial positions but the blades have not yet reached the slot trailing surface 37. The blade bearing surfaces 74*b* disposed at the ends of blade camming surfaces 64 are now positioned to come into facing engagement with the lower outer flat bearing surfaces 48 of the blade-holding portion 36.

FIG. 38 illustrates the blade bearing surfaces 74*a*, 74*b* of the blade corner 72 of one of the blades 14*v* approaching the slot trailing end surface 37 upon full extension of the blade by the blade camming surface 64. The axial distance of the blade from the slot surface is exaggerated for clarity. The opposite ends of the slot surface 37 in the illustrated embodiment each has a chamfered, rounded, or otherwise eased end surface 92 to relieve the sharp corners at the ends of the slot. Continued axial translation of the blade corner 72 towards the lower slot surface 37 receives the eased end surface 38 into the corner. Should the force applied by the target on the blade cause the blade to pivot slightly back from its full extension and cause the blade bearing surface 74 to engage the slot end surface 38, the blade will be forced back into its extended position and the blade corner 72 can receive the cam ring ramp cam surface 82.

FIG. 39 illustrates a variant embodiment of the blade 14*v* to facilitate entry of the end of the slot into the blade corner 72. In this embodiment the camming surface 64 is designed to pivot the blade 14*v* slightly past its full extension. After the camming surface 64 pivots the blade, should the force applied by the target on the blade cause the blade to pivot slightly back from its full extension, the blade corner 72 can still receive the end of the slot.

Embodiments of the broadhead 10 can use eased slot ends or past-full extension pivoting of the blade in combination or separately to assure the lower end of the slot 40 is received in the blade corner 72 to facilitate the blade 14 reaching its extended position against the lower end of the slot.

After the blade bearing surfaces 74*b* begin facing the ferrule's outer lower flat surfaces 48, the blade bearing surfaces 74*b* can press against the ferrule bearing surfaces 48 to resist pivoting of the blades away from their fully extend angular positions. The target force acting against the blades as the broadhead 10 continues to penetrate the target will press the blade bearing surfaces 74*b* against the ferrule bearing surfaces 48, and will urge the blades axially against the trailing slot surface 37 even after the blades have reached the extended position at the lower end of the slot and the broadhead 10 continues to penetrate the target with fully extended blades.

Figure 36:
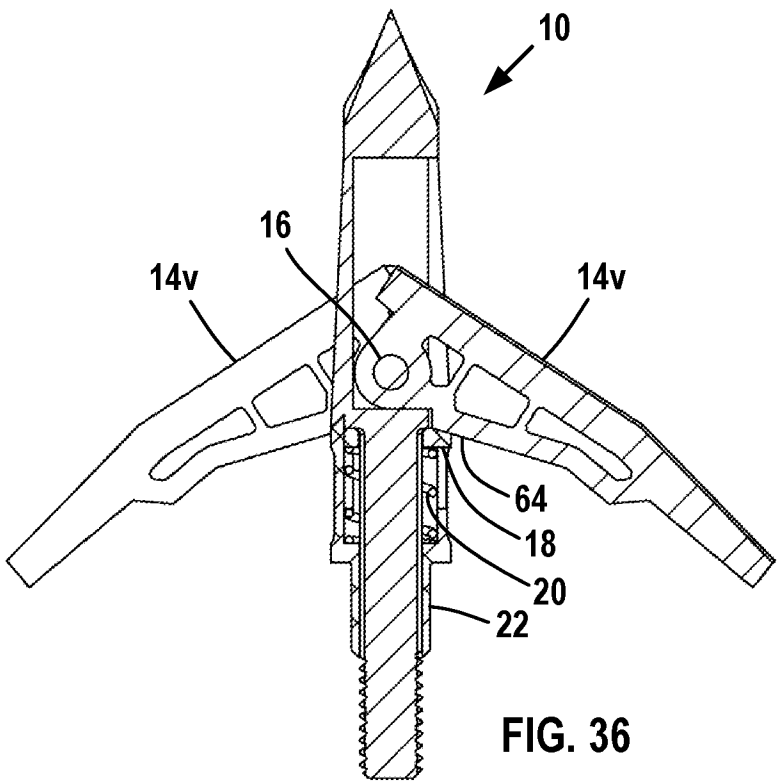
FIG. 36 is a sectional view of the broadhead shown in FIG. 35 taken along line B-B of FIG. 35.

FIGS. 35 and 36 illustrate the broadhead 10 with the blades 14*v* in the extended position. The cam ring 18 is against the ferrule bearing surface 38. In the illustrated embodiment the blade bearing surfaces 74*a* are configured to end flush with the lower ends of the ferrule's lower outer bearing surfaces 48. The cam ring 18 may make contact with the intersections of the blade camming member surfaces 64 and blade bearing surfaces 74*b* to assist in resisting pivoting movement of the blades 14*v* In other possible embodiments of the broadhead in accordance with this disclosure, the blade bearing surfaces 74*b* may extend beyond the ferrule blade-holding portion 36 when the blades 14*v* are in the extended position. See FIG. 41, which illustrates the blade bearing surface 74*a* extending past the lower end of the ferrule lower bearing surface 48, spacing the cam ring 18 away from the lower end of the ferrule blade-holding portion 36. The cam ring further compresses the spring 20 as compared to the spring being against the blade-holding portion 36 as shown in FIG. 36. By the cam member applying force to the blades 14*v*, the cam ring assures spring force resisting pivotal movement of the blades 14*v* towards the ferrule is transmitted to the extended blades 14*v*.

Figure 41:
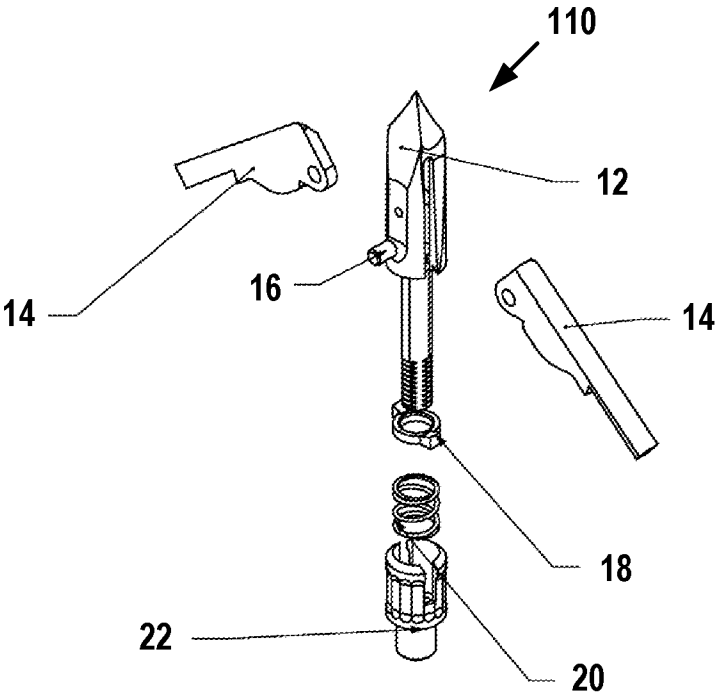
FIG. 41 is an exploded view of a second embodiment rearward deploying broadhead in accordance with this disclosure, the broadhead having solid blades.
Figure 43:
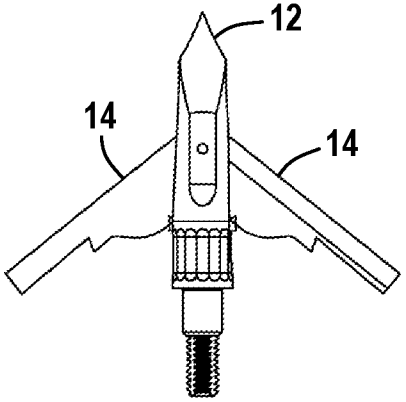
FIGS. 42 and 43 illustrate the broadhead shown in FIG. 41 with the blades in the retracted and deployed positions respectively.
Figure 42:
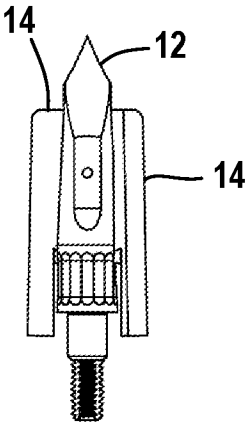

FIGS. 41-43 illustrate a second embodiment rear deploying broadhead 110. Elements of the broadhead 110 corresponding to similar elements of the broadhead 10 are numbered with the same reference numbers as used for the broadhead 10. The broadhead 110 is show with solid blades 14 and can be used with vented blades 14.

The cam member 18 of the first embodiment broadhead 10 urges the blades 14*v*, 14 when in the retracted position to pivot about the pin 16 such that the forward portions of the blades outside of the slot 40 are pressed against the ferrule to limit pivoting of the blades to their retracted positions. The cam member 18 of the second embodiment broadhead 110 urges the blades 14*v*, 14 when in the retracted position to pivot about the pin 16 in the opposite directions than in the broadhead 10 such that rearward portions of the blades outside of the slot 40 press against an obstruction to resist pivoting and define the retracted position of the blades. The rearward portions of the blades can be formed to press against the ferrule blade holding portion 36 (such as by pressing against lower surfaces 48), the member 18 itself, the spring cap 22 or the ferrule shank 38 to limit pivoting of the blades to their retracted positions. In the illustrated broadhead 110 the blades press against the ferrule surfaces 48 when the blades are in the retracted position.

Figure 47:
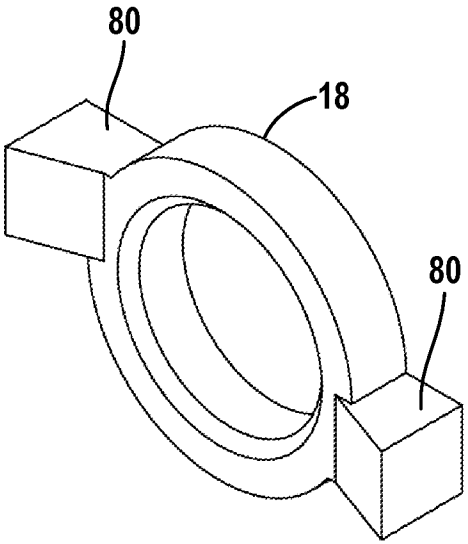
FIGS. 47-50 are perspective, top, and front views respectively of the cam ring shown in FIG. 41.
Figure 50:
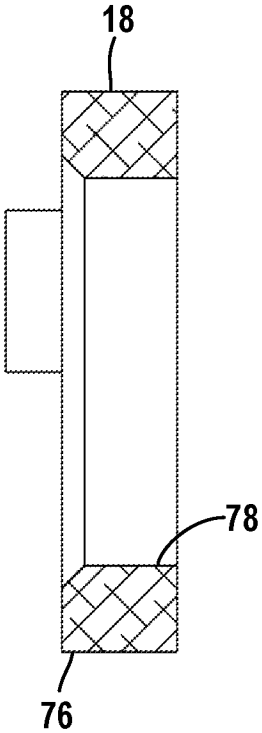
Figure 48:
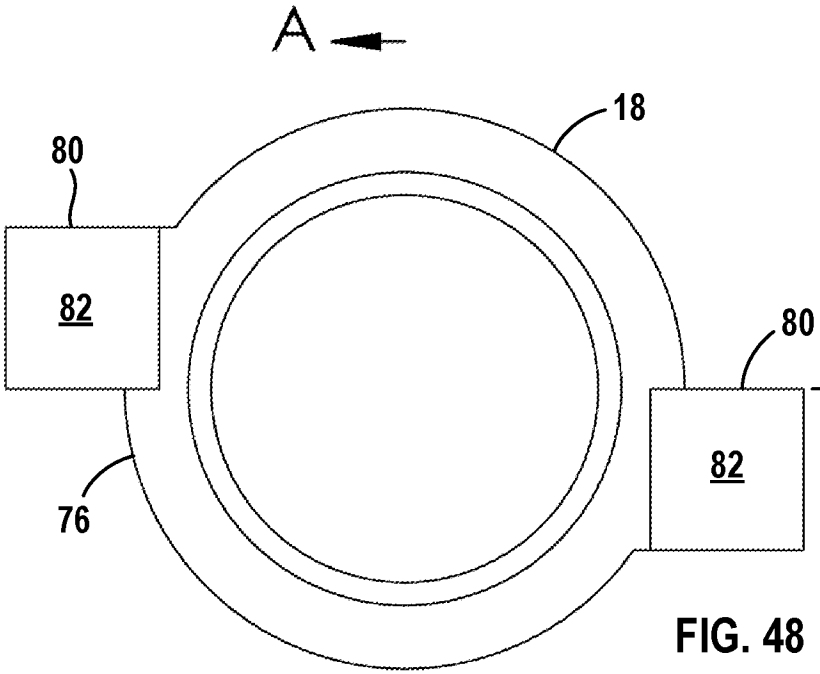
Figure 49:
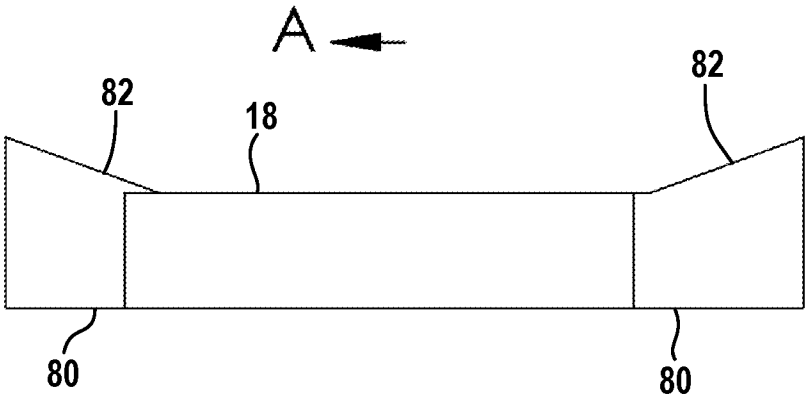

The broadhead 110 includes a slotted ferrule 12 similar to the slotted ferrule 12 of the broadhead 10. The second embodiment blades 14 are similar to the first embodiment blades 14 used with the broadhead 10 but have different bearing surface and cam surface configurations. The blades 14 are pivotally connected by the pivot pin 16 as previously described. The cam member 18 is formed as a cam ring similar to the cam ring 18 used with the broadhead 10, but the cam ring ramps 80 (see FIG. 47) are designed to cooperate with the second embodiment blades 14 to maintain the blades in the retracted position shown in FIG. 42 and the extended position shown in FIG. 43.

The broadhead 110 utilizes the same spring assembly as the broadhead 10, the spring 20 and the spring cap 22 being identical to those used with the broadhead 10.

FIGS. 44-46 illustrate the second embodiment blades 14. The blades 14 are solid, non-ventilated blades, but can be provided as ventilated blades if desired.

The blade 14 extends axially from a leading end 50 to a trailing end 52. A cutting edge 54 extends the full length of one side of the blade. A blade connection portion 56 is located at the leading end of the blade and includes a flat bearing surface 60 located at the leading end of the blade and extending radially to the cutting edge of the blade. The blade connection portion 56 defines a through-hole 62 extending through the thickness of the plate. that closely receives the pin 16. Angularly displaced with respect to the center of the through hole 62 is the square corner 72 defined by corner bearing surfaces 74*a*, 74*b*. The corner surfaces 74*a*, 74*b* are the same as those in the first embodiment blade 14 and assist in retaining the blade in the extended position as previously described.

Extending away from the blade connection portion 56 forming a spine of the blade on the opposite side from the cutting edge is a camming surface 64, then a second surface 66 extending axially to an inclined bearing surface 68 adjacent an axially extending bearing surface 70. The bearing surfaces 68, 70 cooperatively form a corner or recess 71 in the spine of the blade that receives the cam ring 18 and maintains the blade 14 in the retracted position as shown in FIG. 52.

FIGS. 47-50 illustrate the second embodiment cam member 18, formed as a cam ring having a circular body 76 defining a circular hole 78 like the first embodiment cam ring 18. The offset camming members 80 are also formed as ramps, but extend toward the blade-holding portion of the ferrule when the cam ring 18 is mounted on the ferrule shank. The cam ramp cam surfaces 82 are inclined with respect to the longitudinal axis of the ferrule, with radially outer edges being closer to the ferrule blade-holding portion 36 when the cam ring is mounted on the ferrule shank.

Figure 51:
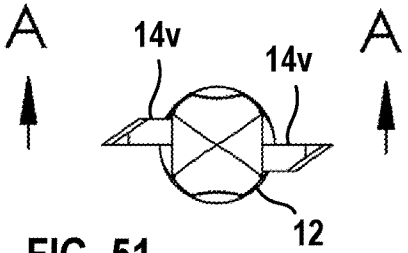
FIG. 51 is a top view of the broadhead shown in FIG. 42.
Figure 52:
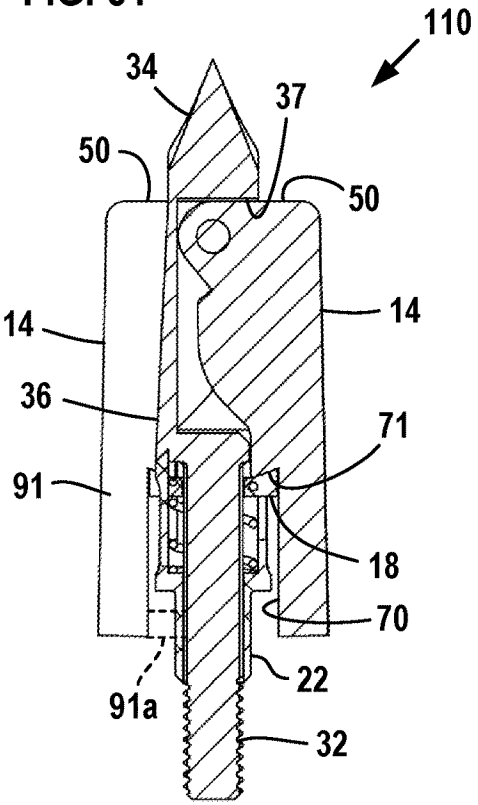
FIG. 52 is a sectional view of the broadhead shown in FIG. 51 taken along line A-A of FIG. 51.

FIGS. 51 and 52 illustrate the broadhead 110 with the blades 14 in the retracted position. The blades 14 locate the cam ring 18 axially spaced away from the blade-holding portion 36 of the ferrule 12, with the cam ring ramp cam surfaces 82 of the cam ring received in respective recesses 71 of the blades 14. The cam ring ramp cam surfaces 82 transmit spring force from the spring 20 to the blade bearing surfaces 68. The spring force urges the blades 14 axially towards the slot leading surface 35 and generates a moment attempting to pivot lower blade portions 91 outside of the slot 40 towards the cam ring. In the illustrated embodiment the portions of the blade forward surfaces 50 in the slot 40 press against the slot leading surface 35 to resist further translation of the blades in the slot and the blade bearing surfaces 66 engage the ferrule lower flat surfaces 48 to limit pivoting of the blades to thereby maintain the blades 14 in their retracted positions.

Alternatively in other possible embodiments the blade bearing surfaces 70 could engage the cam ring 18 as essentially shown in FIG. 52, or the blades 14 could include blade extensions 91 shown in broken lines in FIG. 52 that engage, for example, the spring cap 22, the ferrule shank 32 (possibly through slots in the spring cap or us of some other spring cap geometry), or the arrow attached to the broadhead 110 (depending on the overall length of the blades and the axial positioning of the extension 91*a* along each blade) to limit pivoting of the blades to their retracted positions.

In the retracted position of the blades 14, the blade forward ends 50 are flush with the leading surface 35 of the slot and do not extend upwardly beyond the upper end of the slot. The ferrule upper bearing surfaces 48 of the ferrule 12 of the first broadhead 10 can be eliminated in the broadhead 110, enabling the penetrating tip portion 34 of the ferrule to extend uniformly around the ferrule 12 of the broadhead 110.

Operation of the broadhead 110 in deploying the blades 14 with impact and penetration of a target is described next.

With penetration of the penetrating tip portion 34 into the target, the blade forward ends 50 now impact the target. The impact forces urge the blades 14 and the pin 16 carried by the blades axially away from the upper leading end 35 of the slot 40 towards the lower end 37 of the slot 40.

Initial axial movement of the blades generated by the forces applied to the forward blade ends 50 causes the blades to further displace the cam ring 18 along the shank 32 away from the ferrule bearing surface 38. However, axial movement of the blades brings the blade camming surfaces 64 into contact with respective sides of the slot trailing end surface 37, causing the blades to pivot outwardly out of the slot and towards their fully extended angular positions. The cam surfaces 64 of the blades are curved to enable the forward ends of the blades to pivot into the slot 40 as the blades translate towards the trailing end of the slot 40.

The target additionally applies force to the blades 14 as the broadhead 110 continues to penetrate into the target. As previously described, the force applied to the blades resists the pivoting of the blades, but is not sufficient to prevent angular extension of the blades.

When the blade camming surfaces 64 first engage the slot trailing end surface 37, the blades 14*v* are engaged against the cam ring 18. Pivotal movement of the blades causes the blades to disengage from the cam ring 18. The blades can now translate towards the extended position of the blades without resistance from the cam member 18 compressing the spring 20. This assists in enabling the blades to open and overcome the resistance to blade opening generated by the force applied to the blade by the target. The cam ring 18 is urged by the coil spring 20 against the lower bearing surface 38 of the ferrule blade-holding portion 36.

Figure 53:
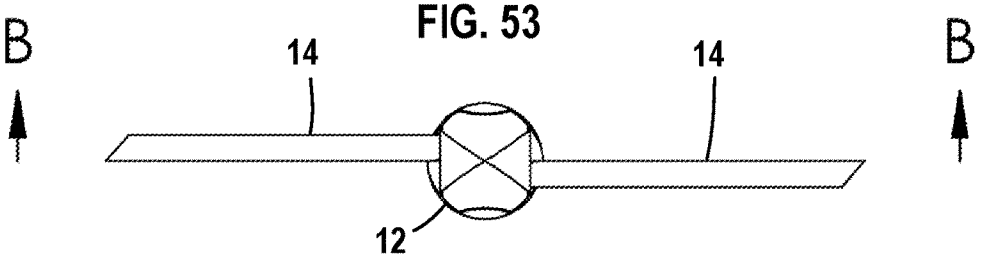
FIG. 53 is a top view of the broadhead shown in FIG. 43.
Figure 54:
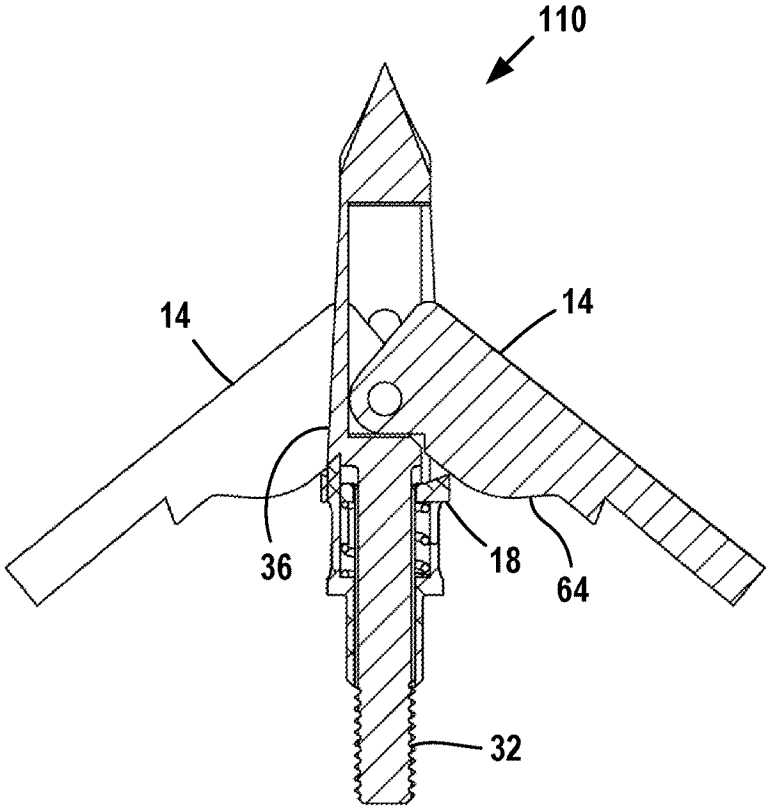
FIG. 54 is a sectional view of the broadhead shown in FIG. 53 taken along line B-B of FIG. 53.

The blades 14 pivot about the pivot pin 16 as the camming surfaces 64 pivot until the blade bearing surfaces 74*a* are against the slot lower trailing surface 37 as shown in FIGS. 53 and 54. The cam ring 18 is spaced away on the shank 32 from the ferrule blade-holding portion 36. The cam ring ramp cam surfaces 82 are engaged against the blade camming surfaces 64, transferring spring force to the blades generating moments urging pivotal movement of the blades 14 about the pin 16 that presses the blade bearing surfaces 74*a* against the slot lower surface 37 when the blades are in their fully extended position.

The blade camming surfaces 64 can be designed to pivot the blades 14 angularly beyond their extended positions prior to the blades reaching the lower end of the slot 40 as previously described with respect to the broadhead 10.

The illustrated broadheads 10, 110 each has a pair of blades that are pivotally connected together by a pin pivotally connecting the members. Other embodiments of the rear deploying broadhead in accordance with this disclosure can utilize other known blade deployment methods used in conventional rear deploying broadheads that enable the blades to move between retracted and extended positions in response to the broadhead impacting and penetrating a target. Examples of such methods are disclosed in, for example, Barrie et al. U.S. Pat. No. 6,626,776, Pulkrabek U.S. Pat. No. 7,771,298, Mizek et al. U.S. Pat. No. 8,469,843, Pedersen U.S. Pat. No. 9,068,806, Pedersen U.S. Pat. No. 9,228,813, and Pedersen U.S. Pat. No. 10,012,486.

Figure 55:
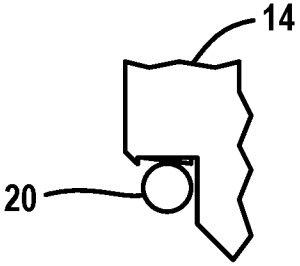
FIG. 55 illustrates a portion of a third embodiment broadhead in accordance with this disclosure in which the spring of the spring system engages the blades directly to transmit spring forces to a blade.

The illustrated broadheads 10, 110 transfer spring force to the blades through the use of a cam member that have cam surfaces that cooperate with the blades to generate forces and moments. In yet other embodiments in accordance with this disclosure, the cam member 18 can be eliminated and the spring 20 directly engages the blades 14, 14*v*. FIG. 55 illustrates the spring received in a recess 94 formed in the blade 14 (or blade 14*v*) when the blade is in the retracted position. A blade recess can also be used to receive the spring when the blade is in the extended position if the blade engages the spring in the extended position. The bearing surfaces of the blades that engage the cam member are designed to function like the cam member cam surfaces 82 to generate the desired force components.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) the number of blades carried by the broadhead, changes in material selection, weight, spring rate, environment of use, size and type of blade design and blade deployment methods, configuration of the shank for different arrow and insert sizes, blade edge type, shapes of blade camming surfaces to control or vary the rate or amount of angular displacement of a blade with translation of the blade from the retracted position to the extended position of the blade, and the like.

What is claimed is:

1. An expandable, rearward deploying broadhead for impacting and penetrating a target when attached to an arrow, the broadhead comprising:

a ferrule, a pair of rear deploying blades, a cam member, and a spring;

the ferrule being an elongate member extending along a longitudinal axis between axially opposite leading and trailing ends of the ferrule;

the ferrule comprising a penetrating tip portion being disposed at the leading end of the ferrule, a blade-holding portion extending axially from the penetrating tip portion, and a shank extending axially away from the blade-holding portion to the trailing end of the ferrule, the shank being configured to attach the broadhead to an arrow;

the blade-holding portion of the ferrule comprising a slot extending axially between spaced apart opposite leading and trailing end surfaces of the slot, the slot extending towards the trailing end of the ferrule as the slot extends from the slot leading end surface to the slot trailing end surface;

the pair of blades being movably mounted in the slot between retracted and extended positions, the pair of blades being against the leading end surface of the slot when the pair of blades are in the retracted position and the pair of blades being against the trailing end surface of the slot when the pair of blades are in the extended position, the pair of blades translating and pivoting with respect to the ferrule when moving from the retracted position to the extended position;

the cam member being disposed on the shank and movable axially with respect to the shank, the spring applying a force to the cam member urging the cam member towards the blade-holding portion of the ferrule when the broadhead is attached to the arrow;

the spring being disposed on the shank and urging the cam member against the blades when the blades are in the retracted position when the broadhead is attached to the arrow, the cam member urging the blades axially against the leading end surface of the slot and urging each blade into pivotal engagement against a member disposed in the path of pivotal movement of the blade that resists continued pivotal movement of the blades whereby the blades are maintained in the retracted position during flight of the arrow towards the target.

2. The broadhead of claim 1 wherein the member disposed in the path of pivotal movement of the blades when the blades are in the retracted position is the ferrule.

3. The broadhead of claim 2 wherein when the blades are in the retracted position:

each blade of the pair of blades comprises a forward portion of the blade extending out of the slot and extending axially beyond the leading end surface of the slot towards the leading end of the ferrule; and the cam member pivotally urges the forward portions of the blades against the ferrule outside of the slot whereby the blades are maintained in the retracted position during flight of the arrow towards the target.

4. The broadhead of claim 3 wherein the forward portion of each blade of the pair of blades comprises a flat bearing surface that engages a respective flat bearing surface on the outside of the ferrule when the blades are in the retracted position.

5. The broadhead of claim 2 wherein when the blades are in the retracted position:

each blade of the pair of blades comprises a trailing portion of the blade extending out of the slot and extending axially beyond the trailing end surface of the slot towards the trailing end of the ferrule; and the cam member pivotally urges the trailing portions of the blades against the ferrule outside of the slot whereby the blades are maintained in the retracted position during flight of the arrow towards the target.

6. The broadhead of claim 5 wherein the trailing portion of each blade of the pair of blades comprises a flat bearing surface that engages a respective flat bearing surface on the outside of the blade-holding portion of the ferrule when the blades are in the retracted position.

7. The broadhead of claim 2 wherein the trailing portion of each blade is pivotally urged against the shank of the ferrule when the blades are in the retracted position.

8. The broadhead of claim 1 wherein each blade of the pair of blades comprises a trailing portion of the blade extending out of the slot and extending axially beyond the trailing end surface of the slot towards the trailing end of the ferrule; and wherein the member disposed in the path of pivotal movement of the blades when the blades are in the retracted position is the cam member.

9. The broadhead of claim 1 wherein the spring is disposed in a spring cap disposed on the shank of the ferrule;

each blade of the pair of blades comprises a trailing portion of the blade extending out of the slot and extending axially beyond the trailing end surface of the slot towards the trailing end of the ferrule; and wherein the member disposed in the path of pivotal movement of the blades when the blades are in the retracted position is the spring cap.

10. The broadhead of claim 1 wherein the broadhead is attached to an arrow;

each blade of the pair of blades comprises a trailing portion of the blade extending out of the slot and extending axially beyond the trailing end surface of the slot towards the trailing end of the ferrule; and wherein the member disposed in the path of pivotal movement of the blades when the blades are in the retracted position is the arrow.

11. The broadhead of claim 1 wherein the pair of blades are side-by-side and are pivotally mounted on a pin defining a common pivot axis of the pair of blades, the pin being axially movable with the pair of blades, the cam member urging the pair of blades to pivot about the pin and translate with the pin towards the leading end of the slot when the blades are in the retracted position.

12. The broadhead of claim 11 comprising a hole extending radially with respect to the longitudinal axis from an outer surface of the ferrule and opening into the slot, the hole being sized to receive and fully pass the pin into the slot.

13. The broadhead of claim 1 wherein each blade of the pair of blades comprises a bearing edge inclined with respect to the longitudinal axis when the blade is in the retracted position, the cam member engages the bearing edges of the pair of blades when the pair of blades are in the retracted position, the cam member transmitting to each blade of the pair of blades, and the force transmitted to each blade of the pair of blades comprising a first force component urging the blade against the leading surface of the slot and a second force component generating a moment urging the blade to pivot about the pin.

14. The broadhead of claim 1 wherein the cam member is spaced away from and not in contact with the blade-holding portion of the ferrule when the blades are in the retracted position.

15. The broadhead of claim 1 wherein the cam member comprises a pair of cam surface inclined with respect to the lateral axis of the ferrule, each cam surface of the cam member bearing against a respective blade of the pair of blades when the blades are in the retracted position.

16. The broadhead of claim 1 comprising a spring cap mounted on the shaft, the spring cap being captured between the blade-holding portion of the ferrule and the arrow when the broadhead is attached to the arrow; and the spring being disposed in the spring cap, the cam member being at least partially disposed within the spring cap, the cam member being disposed along the ferrule shank between the blade-holding portion of the ferrule and the spring, the spring being a compression spring.

17. The broadhead of claim 1 wherein each blade of the pair of blades comprises an impact surface facing towards the leading end of the blade, the impact surface being configured to be impacted by a target upon penetration of the penetrating tip portion into the target, the target when impacting against the impact surfaces of the blades applying an impact force to the blades urging the blades to move axially from the retracted position towards the extended position.

18. The broadhead of claim 17 wherein each blade of the pair of blades comprises a camming surface inclined with respect to the longitudinal axis of the ferrule;

the camming surfaces of the pair of blades being disposed to engage against the lower surface of the slot during translation of the blades from the retracted position to the extended position, the camming surfaces forcing the blades to pivot as the blades continue to translate towards the lower end of the slot while the camming surfaces are against the lower surface of the slot.

19. The broadhead of claim 1 wherein each blade of the pair of blades comprises a cutting edge, the cutting edges of the pair of blades being disposed outside of the slot when the pair of blades are in the retracted position.

20. The broadhead of claim 1 wherein the spring urges the cam member against the blades when the blades are in the extended position wherein the cam member applies a force to the blades pivotally urging the blades against the trailing surface of the slot and thereby assisting the blades being maintained in the extended position while the broadhead is penetrating the target.

21. An expandable, rearward deploying broadhead for impacting and penetrating a target when attached to an arrow, the broadhead comprising:

a ferrule, a rear deploying blade, and a spring;

the ferrule being an elongate member extending along a longitudinal axis between axially opposite leading and trailing ends of the ferrule;

the ferrule comprising a penetrating tip portion being disposed at the leading end of the ferrule, a blade-holding portion extending axially from the penetrating tip portion, and a shank extending axially away from the blade-holding portion to the trailing end of the ferrule, the shank being configured to attach the broadhead to an arrow;

the blade-holding portion of the ferrule comprising a slot extending axially between spaced apart opposite leading and trailing end surfaces of the slot, the slot extending towards the shank as the slot extends from the slot leading end surface to the slot trailing end surface;

the blade being movably mounted in the slot between axially spaced apart retracted and extended positions of the blade, the blade being adjacent to the leading end surface of the slot when the blade is in the retracted position and the blade being adjacent to the trailing end surface of the slot when the blade is in the extended position, the blade translating and pivoting with respect to the ferrule when moving from the retracted position to the extended position;

the spring being disposed on the shank, the spring generating a spring force transmitted to the blade when the blade is in the retracted position;

the spring force urging the blade axially against the leading end surface of the slot and generating a moment pivotally pressing the blade against a member disposed to resist further pivotal movement of the blade whereby the spring force resists translation and angular displacement of the blade away from the retracted position during flight of the broadhead toward a target.

22. The broadhead of claim 21 wherein the spring is a compression spring surrounding the shank.

23. The broadhead of claim 22 further comprising a cam member disposed on the shank between the blade-holding portion of the ferrule and the spring, the cam member being axially movable along the shank, the spring pressing against the cam member and transferring spring force to the cam member urging the cam member towards the blade-holding portion of the ferrule when the broadhead is attached to an arrow, the cam member pressing against the blade when the blade is in the retracted position and transferring spring force from the spring to the blade.

24. The broadhead of claim 23 wherein the cam member is disposed at a first axial position along the shank when the blade is in the retracted position, and the cam member is disposed at a second axial position along the shank axially spaced from the first axial position when the blade is in the extended position.

25. The broadhead of claim 24 wherein the cam member is against the blade-holding portion of the ferrule when the cam member is in the second axial position.

26. The broadhead of claim 21 wherein the member is an outer surface of the ferrule;

the blade comprises a forward portion that extends out of the slot and extends past the leading end of the slot towards the leading end of the ferrule when the blade is in the retracted position wherein the spring force presses the forward portion of the blade against the outer surface of the ferrule to resist pivotal movement of the blade away from the retracted position of the blade.

27. The broadhead of claim 21 wherein the blade comprises a trailing portion that extends out of the slot and extends past the trailing end of the slot towards the trailing end of the ferrule when the blade is in the retracted position wherein the spring force presses the trailing end of the blade against the member to resist pivotal movement of the blade away from the retracted position of the blade.

28. The broadhead of claim 21 wherein the blade comprises an impact surface facing towards the leading end of the blade, the impact surface being configured to be impacted by a target upon penetration of the penetration tip portion into the target wherein the impact applies an impact force to the blade urging axial translation of the blade from the retracted position towards the extended position of the blade.

29. The broadhead of claim 21 wherein the spring generates a spring force transmitted to the blade when the blade is in the extended position urging the blade against the trailing end surface of the slot.

* * * * *